US009611128B2

(12) United States Patent
Van Houten et al.

(10) Patent No.: US 9,611,128 B2
(45) Date of Patent: Apr. 4, 2017

(54) VEHICLE LIFTING SYSTEM WITH CENTRAL CONTROLLER AND METHOD OF USE THEREOF

(71) Applicant: Stertil B.V., Kootstertille (NL)

(72) Inventors: Rudolf Jacobus Antonius Van Houten, Wijnjewoude (NL); Jurjen Jan De Jong, Buitenpost (NL)

(73) Assignee: Stertil B.V., Kootstertille (NL)

( * ) Notice: Subject to any disclaimer, the term of this patent is extended or adjusted under 35 U.S.C. 154(b) by 389 days.

(21) Appl. No.: 14/275,044

(22) Filed: May 12, 2014

(65) Prior Publication Data

US 2015/0307334 A1 Oct. 29, 2015

Related U.S. Application Data

(60) Provisional application No. 61/983,637, filed on Apr. 24, 2014.

(30) Foreign Application Priority Data

Apr. 24, 2014 (NL) ..... 2012679

(51) Int. Cl.
*B66F 7/10* (2006.01)
*B66F 3/46* (2006.01)
(Continued)

(52) U.S. Cl.
CPC ..... *B66F 3/46* (2013.01); *B66F 7/20* (2013.01); *B66F 13/00* (2013.01)

(58) Field of Classification Search
CPC ..... B66F 5/0031; B66F 7/20; B66F 13/00; B66F 3/46
(Continued)

(56) References Cited

U.S. PATENT DOCUMENTS 5,800,114 A 9/1998 Secondi
6,315,079 B1 11/2001 Berends et al.
(Continued)

FOREIGN PATENT DOCUMENTS

AT 325811 1/1975
CA 2406340 A1 12/2003
(Continued)

*Primary Examiner* — Anthony Salata
(74) *Attorney, Agent, or Firm* — The Webb Law Firm

(57) ABSTRACT

A lifting system and method of use thereof for lifting a vehicle. The lifting system includes one or more lifting devices. Each lifting device includes a frame with a carrier configured for carrying the vehicle, a drive for driving the carrier in at least one of the ascent or decent of the carrier, a transmitter/receiver for wireless communication with a central controller that is configured for centrally controlling the one or more lifting devices, and a sensor for measuring at least one of the ascent or descent of the carrier. The central controller includes a transmitter/receiver for communication with individual lifting devices and a processor for determining required control actions for individual lifting devices. The central controller and/or at least one of the lifting devices includes a user input. The central controller controls two or more independent groups of selected lifting devices.

11 Claims, 7 Drawing Sheets

(51) Int. Cl.
*B66F 13/00* (2006.01)
*B66F 7/20* (2006.01)

(58) Field of Classification Search
USPC ..... 187/204, 207, 209, 210, 213, 219, 220, 187/247, 277, 391–393, 203
See application file for complete search history.

(56) References Cited

U.S. PATENT DOCUMENTS

| | | | | |
|---|---|---|---|---|
| 6,634,461 | B1 | 10/2003 | Baker | |
| 6,983,196 | B2 * | 1/2006 | Green | B66F 7/04 254/45 |
| 7,014,012 | B2 | 3/2006 | Baker | |
| 7,025,178 | B2 * | 4/2006 | Wengelski | B60S 9/12 187/244 |
| 7,219,770 | B2 | 5/2007 | Baker | |
| 7,712,583 | B2 * | 5/2010 | Matsumoto | B66F 7/20 187/224 |
| 7,740,109 | B2 | 6/2010 | Moller et al. | |
| RE41,554 | E | 8/2010 | Baker | |
| 7,784,587 | B2 * | 8/2010 | Zablocky | A61G 3/06 187/223 |
| 8,083,034 | B2 * | 12/2011 | Bordwell | B66F 7/20 187/210 |
| 8,251,184 | B2 * | 8/2012 | De Jong | B66F 7/16 187/210 |
| 8,567,761 | B2 * | 10/2013 | De Jong | B66F 3/46 254/134 |
| 8,708,107 | B2 * | 4/2014 | Finkbeiner | B66F 3/46 187/213 |
| 8,944,217 | B2 * | 2/2015 | Anasis | B66D 1/605 182/148 |
| 9,352,944 | B2 * | 5/2016 | Fagan | B66F 3/46 |
| 2005/0182522 | A1 | 8/2005 | Chase | |
| 2008/0154691 | A1 | 6/2008 | Wellman et al. | |
| 2008/0277204 | A1 | 11/2008 | Moller et al. | |
| 2009/0205907 | A1 | 8/2009 | Berends | |
| 2009/0236183 | A1 | 9/2009 | Bordwell et al. | |
| 2010/0066278 | A1 | 3/2010 | De Jong | |
| 2010/0066287 | A1 | 3/2010 | Street | |
| 2011/0037041 | A1 | 2/2011 | DeJong et al. | |
| 2013/0240300 | A1 † | 9/2013 | Fagan | |
| 2013/0240812 | A1 | 9/2013 | Helmich | |
| 2013/0270040 | A1 | 10/2013 | Berends | |
| 2015/0232309 | A1 * | 8/2015 | Jaipaul | B66F 7/04 414/800 |
| 2015/0246797 | A1 * | 9/2015 | Jaipaul | B66F 3/46 700/225 |

FOREIGN PATENT DOCUMENTS

| | | | |
|---|---|---|---|
| DE | 3618072 | A1 | 12/1987 |
| EP | 0747535 | A1 | 12/1996 |
| FR | 1373217 | A | 8/1964 |
| FR | 2631017 | A1 | 11/1989 |
| WO | 2008074008 | A2 | 6/2008 |

* cited by examiner
† cited by third party

VEHICLE LIFTING SYSTEM WITH CENTRAL CONTROLLER AND METHOD OF USE THEREOF

CROSS-REFERENCE TO RELATED APPLICATIONS

This application claims priority to U.S. provisional application No. 61/983,637, filed Apr. 24, 2014, and to Dutch patent application no. NL 2012679, also filed Apr. 24, 2014, both entitled "LIFTING SYSTEM WITH CENTRAL CONTROLLER FOR LIFTING A VEHICLE WITH MOVEABLE LIFTING COLUMNS, AND METHOD THEREFOR", both of which are incorporated herein by reference.

BACKGROUND OF THE INVENTION

Field of the Invention

The invention relates to a vehicle lifting system and more specifically to a system comprising one or more moveable lifts or lifting devices, such as lifting columns. In general, lifting systems are specifically used for lifting trucks and busses or other vehicles.

Description of Related Art

A lifting column known from practice comprises a frame with a carrier that is connected to a drive for moving the carrier upwards and downwards. In the ascent mode, hydraulic oil is pumped to a cylinder for lifting the carrier and, therefore, the vehicle. In the descent mode, the carrier with the vehicle is lowered and hydraulic oil returns to the reservoir. Such prior art lifting system is disclosed in U.S. Patent Application Publication No. 2006/0182563, which is incorporated herein by reference.

Known systems for lifting and lowering a vehicle often include a number of moveable lifting columns that communicate wireless with each other. Correct operation of the lifting system depends on correct and reliable communication of wireless signals. In a workshop wireless signals can be disturbed by large structures, such as vehicles, and other wireless devices sending and receiving signals. Due to disturbed communication lifting systems do not operate effectively and hazardous situations may result from such disturbed communication.

An object of the invention is to obviate or at least reduce some of the above problems.

SUMMARY OF THE INVENTION

This object is achieved with a lifting system for lifting a vehicle according to the invention, the vehicle lifting system comprising:

a frame with a carrier configured for carrying the vehicle;

a drive for driving the carrier in at least one of the ascent or decent of the carrier;

a transmitter/receiver for wireless communication with a central controller;

a sensor for measuring at least one of the ascent or descent of the carrier; and wherein the lifting system comprises a central controller for centrally controlling the one or more lifting device, the central controller comprising:

a transmitter/receiver for communication with individual lifting devices, computing means, such as a processor, for determining required control actions for individual lifting devices, wherein at least one of the central controller or at least one of the lifting devices comprises user input means configured for providing the central controller with input.

Lifting devices of the lifting system according to the invention may include moveable/mobile lifting columns with wireless communication means.

The central controller can determine and communicate required control actions to the individual lifting devices, such as moveable lifting columns. The central controller can use computing means, such as a processor, to determine the required and/or desired control actions. This may involve comparing height measurements from different lifting devices and calculating a corrective action, if necessary. The central controller can be positioned such that all communication between an individual lifting device and the central controller has a minimum risk of being disturbed. This contributes to a safe and robust operation with the lifting devices. For example, the central controller can be positioned above a group of lifting devices it is controlling. This may involve attaching the central controller to a ceiling of the workshop, for example.

A further advantage of working with a central controller is that it is not required to provide individual lifting columns with computing means. This reduces the complexity and associated costs of the individual lifting columns.

In an embodiment according to the invention the central controller can be used to control a group of selected lifting devices. In case of moveable lifting columns such selection can be made in a manner known to the skilled person, for example as described in U.S. Pat. No. 7,500,816, which is incorporated herein by reference. The selection of individual lifting columns may involve the use of a key or card.

In a further embodiment according to the invention the central controller can be capable of controlling multiple groups of selected lifting devices. This renders the use of a central controller further cost effective. For example, a work shop with a number of moveable lifting columns may involve a changing number of groups of a varying number of selected lifting columns. Different groups can be controlled with a single central controller. By improving communication between a central controller and individual lifting columns enhances possibilities for controlling multiple groups of selected lifting columns with one central controller. As mentioned earlier the communication can be improved by optimal positioning the central controller, for example above the lifting columns.

Optionally the system further can comprise a signal distributor for receiving and forwarding signals between the central controller and one or more of the individual lifting columns. Such distributor may comprise a wireless signal transceiver. This provides further flexibility to the position of the central controller relative to the lifting columns. In addition, the distributor further increases the working area of the central controller.

To enable multiple group control with a central controller, the central controller may comprise multiple computing means such as multiple processors, for example processor or group of processors for a group of selected lifting columns. Alternatively, the central controller can comprise means to allocate processor time to a specific group of selected lifting columns. These allocation means may involve an optimizing control algorithm and/or a separate allocation processor and/or a dedicated allocation program.

In a further embodiment the central controller can be moveable/portable. Such moveable central controller can effectively be used to control moveable lifting columns. To enable movement of the central controller a cart or wheels can be attached on or to the central controller.

In a further preferred embodiment according to the invention the central controller can comprise communication means to enable communication with one or more external networks. Such external networks may include one or more of the following: workshop network for scheduling workshop jobs, financial network for billing purposes, service and maintenance network, for example. It will be understood that other external or internal company networks can also be coupled to the central controller. Examples of direct coupling of lifting columns with an external network is described in U.S. 61/844,616, which is incorporated herein by reference.

Often, lifting devices such as lifting columns can be used freely by a user. In some of these conventional systems a user requires an identification enabling the user to control the lifting system. Although this identification of the user enables monitoring the user, and to some extent guarantees the use of the lifting system by authorized personnel only, the correct use of the lifting system by an identified and/or authorized user cannot be guaranteed under substantially all circumstances. In practice this may lead to unneeded lifting operations or even undesired lifting operations that may reduce the life span of the lifting system and/or increase maintenance costs. In addition, undesired lifting operations may even lead to safety concerns. Furthermore, there is no monitoring and/or control of the lifting system in view of the relation between lifting costs of the lifting system as a whole and an individual lifting operation for a specific vehicle, for example. Therefore, there is a need for monitoring and/or control of actual use of the lifting system.

As an example, in an embodiment of a lifting system according to the invention, at least two lifting columns are being used as lifting devices. In fact, often four lifting columns are being used. During such lifting operation, the timing of these separate lifting columns and, according to the invention especially the moving speed of the carrier that carries (part of) the vehicle when lifting a vehicle, can require synchronization. The central controller can synchronize the height of the separate carriers in the ascent mode using, for example, a measurement signal generated by a height sensor, for example, a potentiometer. Of course, other sensors can also be used. In case one of the carriers has moved too fast in the ascent mode and is too high as compared to the other carriers of the other lifting columns of the group, power supply to this carrier can be either directly or indirectly lowered so that the other carriers can catch up or, alternatively, the power supply to the other carriers can be either directly or indirectly increased so that the other carriers can catch up. In the descent mode, it is also important that the height of the carriers between the several lifting columns is synchronized. Therefore, in case one of these carriers has moved too slowly, its power supply can be increased in order for this carrier to catch up with the other carriers or, alternatively, the power supply to the other carriers can be either directly or indirectly lowered so that the other carriers can catch up.

Enabling communication between the central controller and external networks provides remote servicing of the lifting system. This may even involve remote control of the lifting system. For example, the manufacturer of the lifting system may service the lifting system remotely involving regular maintenance and/or trouble shooting.

Furthermore, enabling communication between the central controller and external networks provides additional logistic and scheduling benefits. For example, an operator may inform the logistics/scheduling department directly from the lifting system that a vehicle is ready to be used. This may significantly reduce the time period a vehicle is not available. This is especially relevant for vehicles that are commercially used, such as busses and refuse trucks. Also, an operator may directly inform (governmental) organizations that a vehicle is ready for inspection, for example for a general periodic check (for example the APK according to regulations in The Netherlands). Enabling communication between the central controller and external networks brings the office to the lifting system reducing the time period that a vehicle is not available for use.

In a presently preferred embodiment according to the present invention the central controller can comprise an input for receiving a clearance signal from a clearance system.

By providing a clearance system the lifting system can be provided with a clearance signal such that the lifting system can be put into operation. After receipt of the clearance signal the release system may release the lifting system, for example by releasing a clamp of the carrier thereof and/or by releasing a software stop, thereby enabling a lifting operation. The clearance signal can be sent to the input of the controller by the clearance system that can be physically located attached to or adjacent the lifting system or also remotely. The clearance signal can be sent to the controller through a wired connection or a wireless connection.

In a preferred embodiment the clearance system generates a clearance signal after receiving a payment for performing the required lifting operation. This payment can be received through a pre-paid card that is offered to the lifting system directly at the lifting device and/or at the clearance system. Alternatively, or in addition thereto, the clearance system can provide an authorisation to perform a number of lifting operations, optionally in a specific time period. Furthermore, the clearance system may send a clearance signal and collect the data such that debit information can be provided to the accountant/billing department and/or debit the client directly. This enables a direct coupling of the lifting operation to the (end)-user. This renders the use of the lifting system according to the present invention cost controlled, thereby further preventing undesired and/or unneeded lifting operations. Furthermore, this provides the opportunity and possibility for operational leasing or renting the lifting system according to the present invention and pay for a specific lifting operation as an alternative to, or in addition to, a payment for the lifting system as such.

The lifting system can furthermore be provided with a release system for releasing the carrier. After the carrier has been released the lifting system is capable of being used by a user for lifting a vehicle. The release system may involve locking and/or unlocking means. Examples thereof include software locks locking the use of a pump or motor and hardware locks physically blocking movement of the carrier. Preferably, the release system responds to a clearance signal or an absence of such clearance signal.

Providing a release system enables direct control and/or monitoring of the lifting system according to the present invention. In use, this is preferably combined with an identification and/or authorisation of the user that is working with this lifting system. This enables a close watch of the lifting system thereby improving maintenance operations, for example. In addition, by providing a release system the number of lifts can be monitored closely and undesired and/or unneeded lifts can be avoided.

Furthermore, monitoring the movements of the lifting system and providing the release system enables direct coupling of a lifting operation for a specific vehicle to the costs associated with using the lifting system according to the present invention. This also enables direct debiting of the vehicle owner for usage of the lifting system, a type of so-called pay-per-lift debiting system.

A sensor can measure directly or indirectly the ascent or descent of the carrier. For example, such sensor may involve one or more of the sensors: displacement sensor, load sensor, pump activity sensor, motor runtime sensor, activity sensor for switches and/or buttons. This provides information on the actual use of the lifting system according to the present invention. More specifically, the sensor provides information by directly or indirectly sensing (vertical) movement of the carrier to the central controller.

In a presently preferred embodiment according to the present invention the sensor can comprise a displacement sensor for measuring a displacement of the carrier.

By providing a displacement sensor a movement of the carrier can be detected. This information can be used by the controller to cost effectively control the lifting system according to the present invention. Such displacement sensor can be a potentiometer and/or an inclinometer, for example. The sensor provides feedback to the controller that the requested lifting operation has been started and/or is completed.

In a presently preferred embodiment the sensor can comprise a load sensor. This enables coupling the actual load that is put on the carrier to the specific use of the lifting system for a specific vehicle and/or end-user such as the vehicle owner. This is a further step to the pay-per-lift system as the actual load that is put on the carrier of the lifting system can be taken into account such that the actual payment can be adjusted for the load.

In a further preferred embodiment of the present invention the sensor can comprise a pump activity sensor. This pump activity sensor enables detecting the status of the pump. When the pump is active, hydraulic oil will be provided to a cylinder that may act as a drive for driving the carrier. Alternatively, or in addition thereto, the sensor may comprise a motor runtime sensor. Such a motor runtime sensor provides information over the actual status of the motor and the motor runtime as a measure for the use of the lifting system according to the present invention. Alternatively, or in addition thereto, the sensor may comprise an activity sensor determining the position of the lifting and/or lowering switch or button.

It will be understood that the sensor may comprise one of the sensors mentioned above as well as a combination of two or more of these sensors.

In a further preferred embodiment according to the present invention, the lifting system can comprise a vehicle detector.

By providing a vehicle detector the type of vehicle can be detected. This information can be used by the controller to adjust the settings of the lifting system. In addition thereto, this information can be used by the release system and/or clearance system to provide additional information and improve the operation of the entire lifting system. This may involve use of this information for sending payment instructions. The vehicle detector may comprise a camera or camera system. Alternatively, or in addition thereto, the vehicle detector may comprise other detector means such as a RFID system with a reader for reading a RFID-tag provided in a vehicle.

Optionally, a camera system and/or other vehicle detector can be used for vehicle recognition such that the operational costs for the lifting operation can be linked to a specific vehicle. For example, this recognition of a specific vehicle can be performed through the license plate number that can be recognized by the camera.

In a presently preferred embodiment according to the present invention the controller can comprise a transmitter and/or receiver for remotely controlling the release system.

By remotely controlling the release system, a remote control can be performed. This may involve remotely providing a release signal and/or clearance signal. This enables the use of one controller or control system for a number of lifting systems. This is especially advantageous for a work shop, for example.

The invention further relates to a method for controlling a lifting system as described above for lifting a vehicle, the method comprising the steps:

providing the lifting system described above; and controlling the lifting system with the central controller.

The same effects and advantages apply for the method as described for the system.

In a presently preferred embodiment the central controller can be capable of being positioned optimally to improve communication between individual lifting columns and the central controller. The central controller can be optionally capable of controlling multiple groups of selected lifting columns. This is especially advantageous for large workshops having a relatively large number of moveable lifting columns.

In a further presently preferred embodiment the release signal can be provided after a clearance signal has been received from a clearance system. In one of the possible embodiments, a release signal can be generated by the central controller, while the clearance signal can be generated remotely by the clearance system. This clearance system preferably provides the clearance signal in response to receiving and/or generating debiting instructions. This may involve the use of pre-paid cards, generating debiting instructions etc. In a possible embodiment according to the invention the clearance signal can actually comprises a payment. An example of such payment is the use of a pre-paid card and/or payment by mobile phone. Optionally, this payment is directly made at the lifting system. This enables a direct coupling between an individual lifting operation and the cost/payments for the use thereof.

It is noted that features mentioned in relation to the system can be applied to the method according to the invention, and vice versa.

BRIEF DESCRIPTION OF THE DRAWINGS

Further advantages, features and details and of the embodiment will be elucidated on the basis of preferred embodiments therefore wherein reference is made to the accompanying drawings, in which.

DESCRIPTION OF THE INVENTION

The following description is merely exemplary in nature and is in no way intended to limit the invention, its application, or uses. While the disclosure is described as having exemplary attributes and applications, the present disclosure can be further modified. This application is therefore intended to cover any variations, uses, or adaptations of the disclosure using its general principles. Further, this application is intended to cover such departures from the present disclosure as come within known or customary practice of those skilled in the art to which this disclosure pertains and which fall within the limits of the appended claims. Accordingly, the following description of certain embodiments and examples should be considered merely exemplary and not in any way limiting.

The lift control system of the present invention is suitable for use with lift systems comprising any number of lifting devices that require height control columns, including systems having one, two, four or another number of columns. The columns may achieve lifting and lowering capability by any means known to those of skill in the art, including hydraulically, electrically, mechanically, and electromechanically. Lift systems compatible with the present lift control system may be stationary and/or permanently affixed or attached to a certain location or may be mobile, capable of being transported via wheels or any other suitable means known to those in the art. With reference to the figures, like element numbers refer to the same element between drawings.

Figures 1A, 1B:
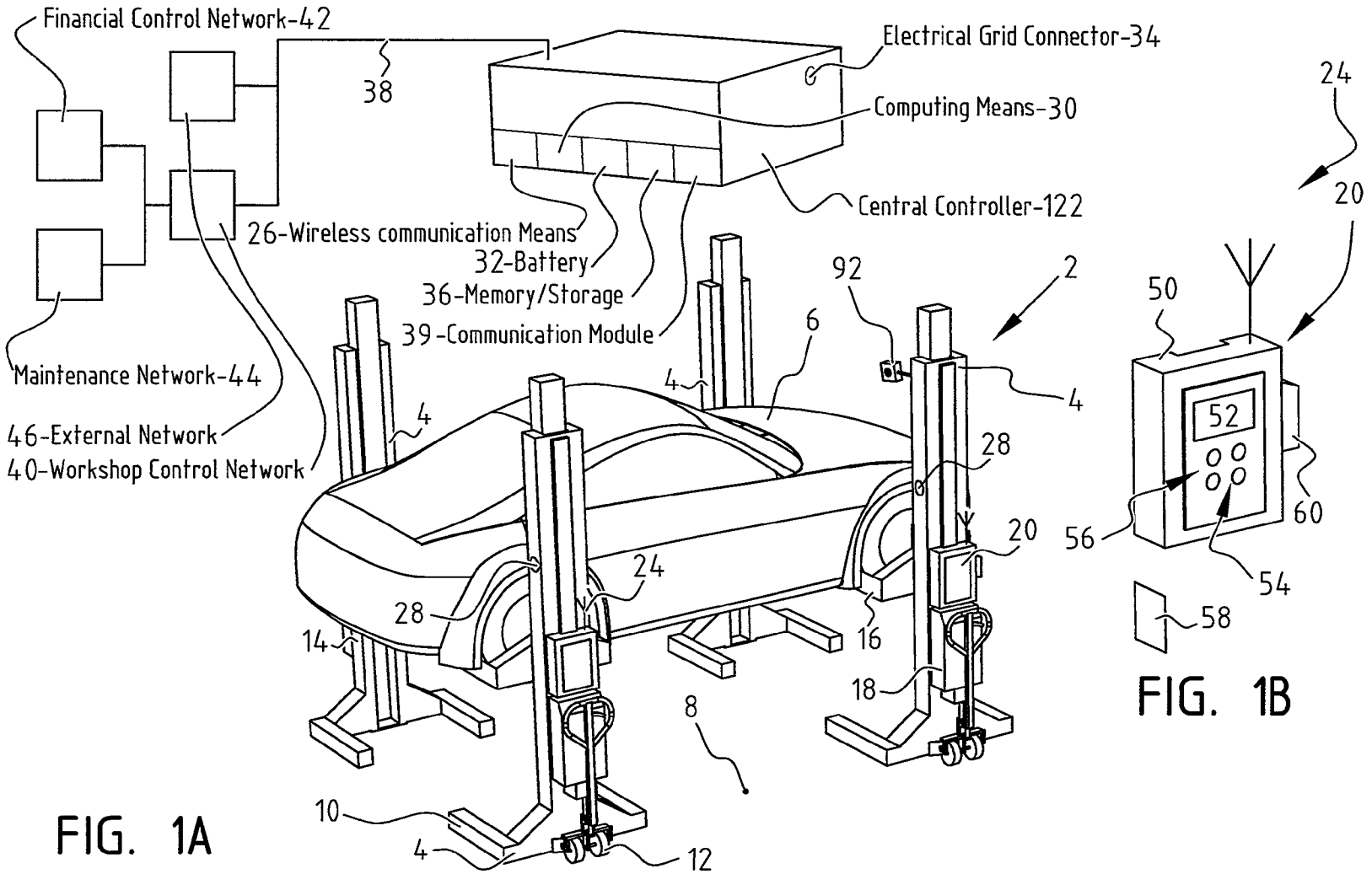
FIG. 1A shows a schematic overview of a lifting system according to the invention.
FIG. 1B shows an isolated view of a single controller of FIG. 1A.

Lifting system 2 (FIG. 1A) comprises four mobile lifting columns 4 in the illustrated embodiment. Lifting columns 4 lift passenger car 6 from ground 8. Lifting columns 4 comprise a foot 10 which can travel on running wheels 12 over ground surface 8 of for instance a floor of a garage or workshop. In the forks of foot 10 is provided an additional running wheel (not shown). Lifting column 4 furthermore comprises mast 14. A carrier 16 is moveable upward and downward along mast 14. Carrier 16 is driven by a motor 18 that is provided in a housing of lifting column 4. Motor 18 is supplied with power from the electrical grid or by a battery that is provided on lifting column 4 in the same housing as motor 18, or alternatively on foot 10 (not shown). A display unit 20 of each column 4 may provide the user with information about the lifting system.

Lifting columns 4 are connected to central controller 22 by wireless communication means 24 on individual lifting column 4 and wireless communication means 26 on central controller 22. Wireless communication means 24, 26 involve one or more transmitters and/or receivers.

The illustrated lifting system 2 includes at least two lifting columns 4. Each of the lifting columns has at least one ascent mode and one descent mode, and is under the influence of central controller 22. In the illustrated embodiment controller 22 is positioned centrally above lifting columns 4 assuring a good communication path between the individual lifting columns 4 and the central controller 22.

Central controller 22 determines the desired control actions. This may involve receiving a measurement signal representing the actual height of a carrier of an individual lifting column that is measured with height sensor 28 attached to an individual lifting column 4. Sensor 28 is capable of measuring position and/or speed of carrier 16. In the illustrated embodiment sensor 28 is a potentiometer and/or an inclinometer.

Central controller 22 detects height differences between lifting columns, calculates the required control actions with computing means 30, such as a processor, for individual lifting columns, and communicates the control actions to the relevant individual lifting columns. In the illustrated embodiment battery 32 provides power to central controller 22. Alternatively, or in addition, power is provided through connection 34 to the electrical grid. Data can be stored in memory/storage 36. Central controller is provided with a wired and/or wireless connection 38 to enable connection between communication module 39 of central controller 22 to internal and/or external networks, involving internal company networks for workshop control 40, financial control 42 and maintenance 44, for example, and external networks 46 of suppliers and/or customers, for example.

Display unit 20 (FIGS. 1A and 1B) comprises housing 50, a display 52, preferably a touch screen, optionally a number of buttons 54, an RFID antenna 56 enabling a user to identify himself with an ID-key 58 and/or pay for a number of lifts with a pre-paid card. In the illustrated embodiment unit 20 further comprises position determining means 60 and communication means 24, preferably providing wireless functionality to communicate in one or more environments such as LAN, WAN, VPN intranet, internet, etc. that are schematically shown in the illustrated embodiments. Unit 20 is further provided with input/output ports, such as USB, SD card reader, smart phone communication possibilities etc. to improve the functionality. Display 52 may provide warning signals to the user. Display 52, preferably a TFT-LCD, is protected by a display lens cover of a resilient material, preferably scratch-resistant.

In system 2 a user performs a selection of lifting columns 4 that are incorporated in a group of selected lifting columns with a key or card 58 or other means. Preferably the selected group of lifting columns 4 in system 2 is provided with user instructions on one of the lifting columns 4, using display 52, for example. Transmitter/receivers 24, 26 provide the instructions to central system controller 22. On a central level controller 22 determines the individual control actions to be taken for all lifting columns 4 in system 2. Transmitter/receivers 24, 26 provide the control actions from the central controller to the individual lifting column 4. Information about the actual position of carrier 16 and/or other relevant data is measured, e.g., via height sensor 28, and the measurement data is provided to central controller 122 that determines if and what control actions are required. No direct communication between individual lifting columns 4 is required. This significantly contributes to the robustness of lifting system 2.

Figure 2:
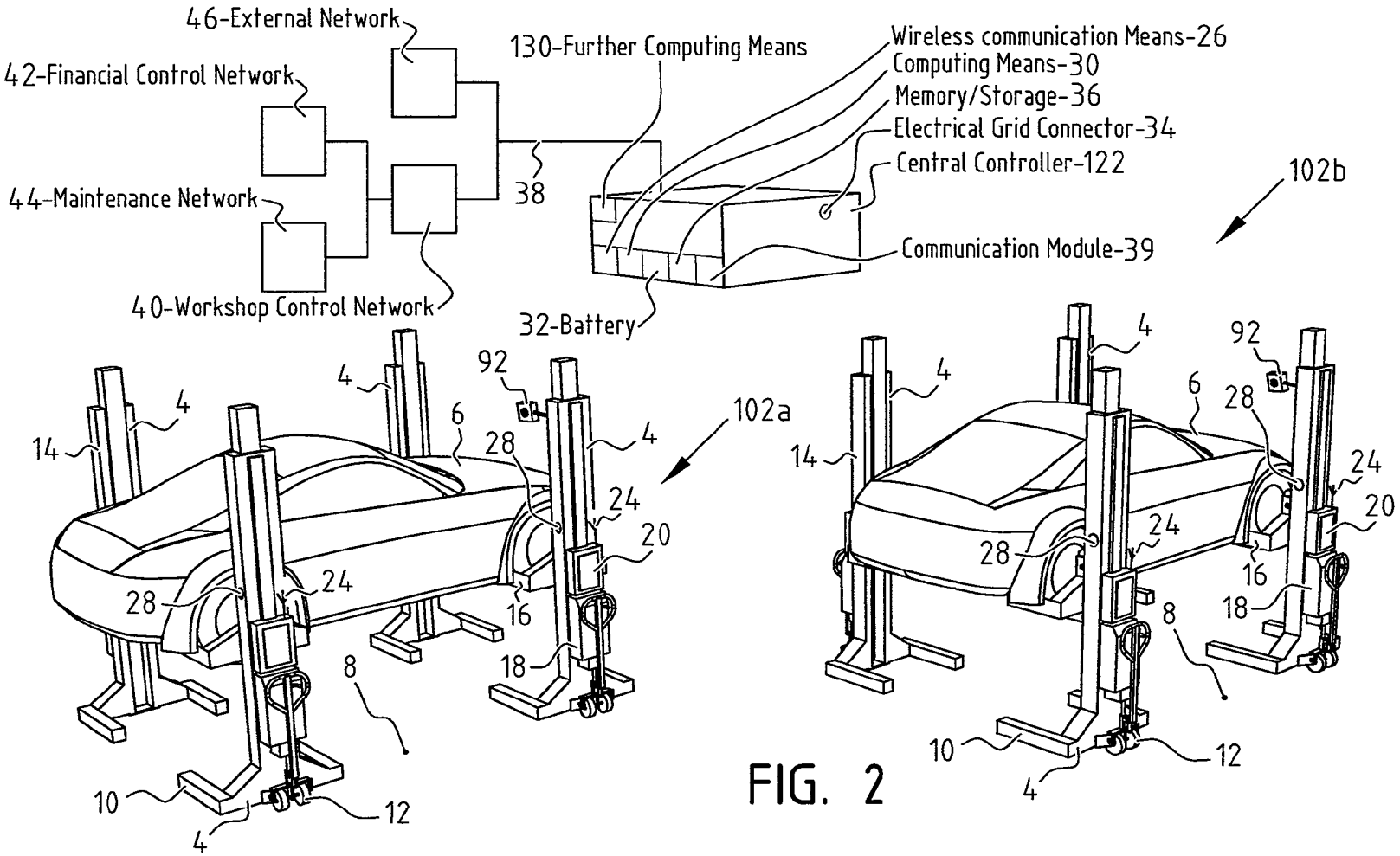
FIG. 2 shows an alternative system comprising a central group controller.

In an advantageous embodiment according to the invention, central controller 122 (FIG. 2) can be used to control a first group 102*a* of lifting columns 4 and a second group 102*b* of lifting columns 4. Operation and control of a single group 102*a*, 102*b* is substantially similar to the operation and control of a single system 2 with lifting columns 2. Optionally, first computing means 30 is provided with second or further computing means 130. Furthermore, central controller 122 can be provided with additional multiple components to improve overall control operation and robustness.

Figure 3:
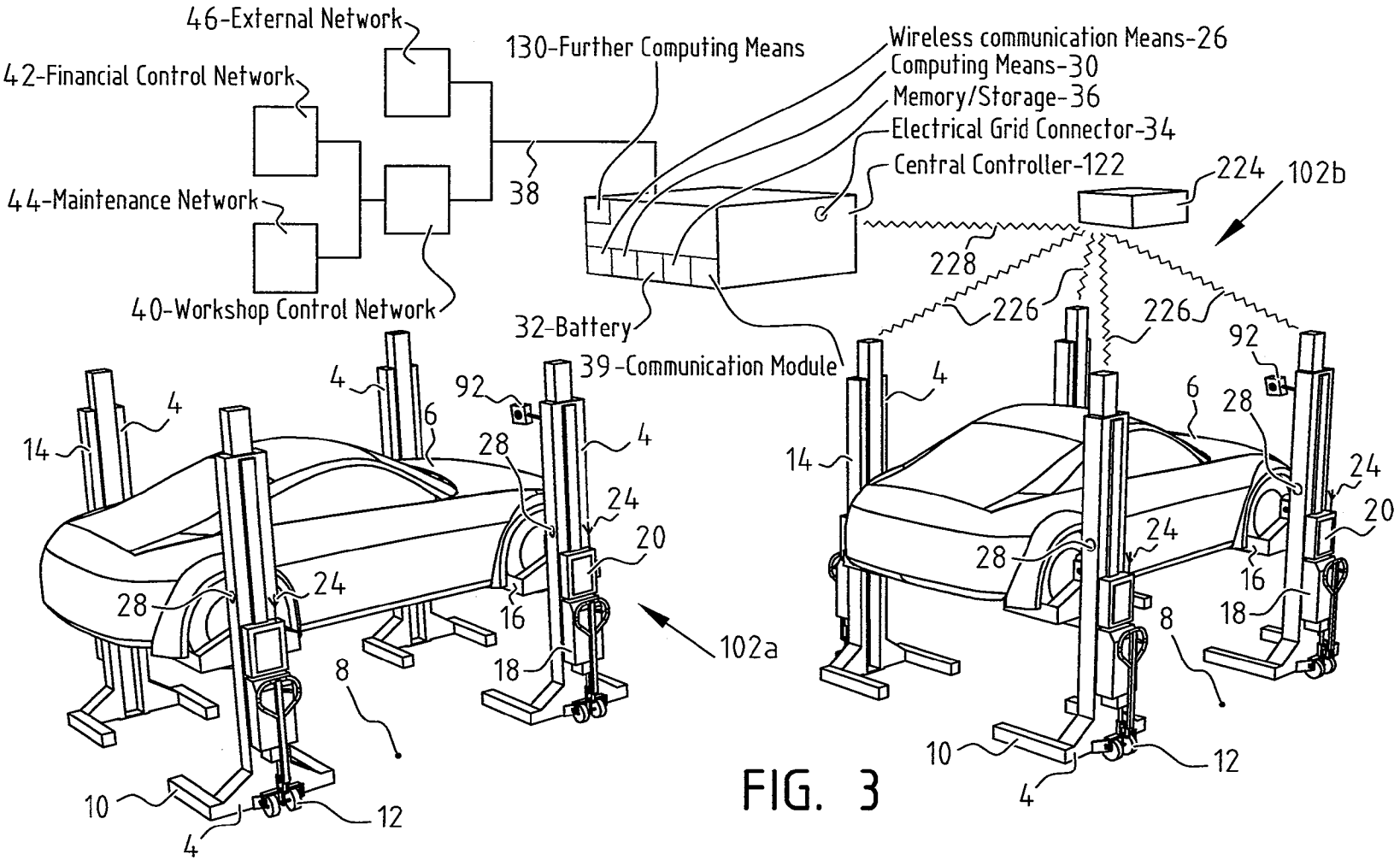
FIG. 3 shows a further alternative system comprising the central group controller of FIG. 2 and additional communicators.

In a further embodiment central controller 222 (FIG. 3) is provided with a number of communicators/distributors 224, such as an RF-host, that send and/or receive signals 226 between lifting columns 4 and communicator 224, and signals 228 between communicator/distributor 224 and central controller 222. Communicators/distributors 224 provide additional robustness to the overall operation of the groups 102*a*, 102*b* of lifting columns 4.

Figure 4:
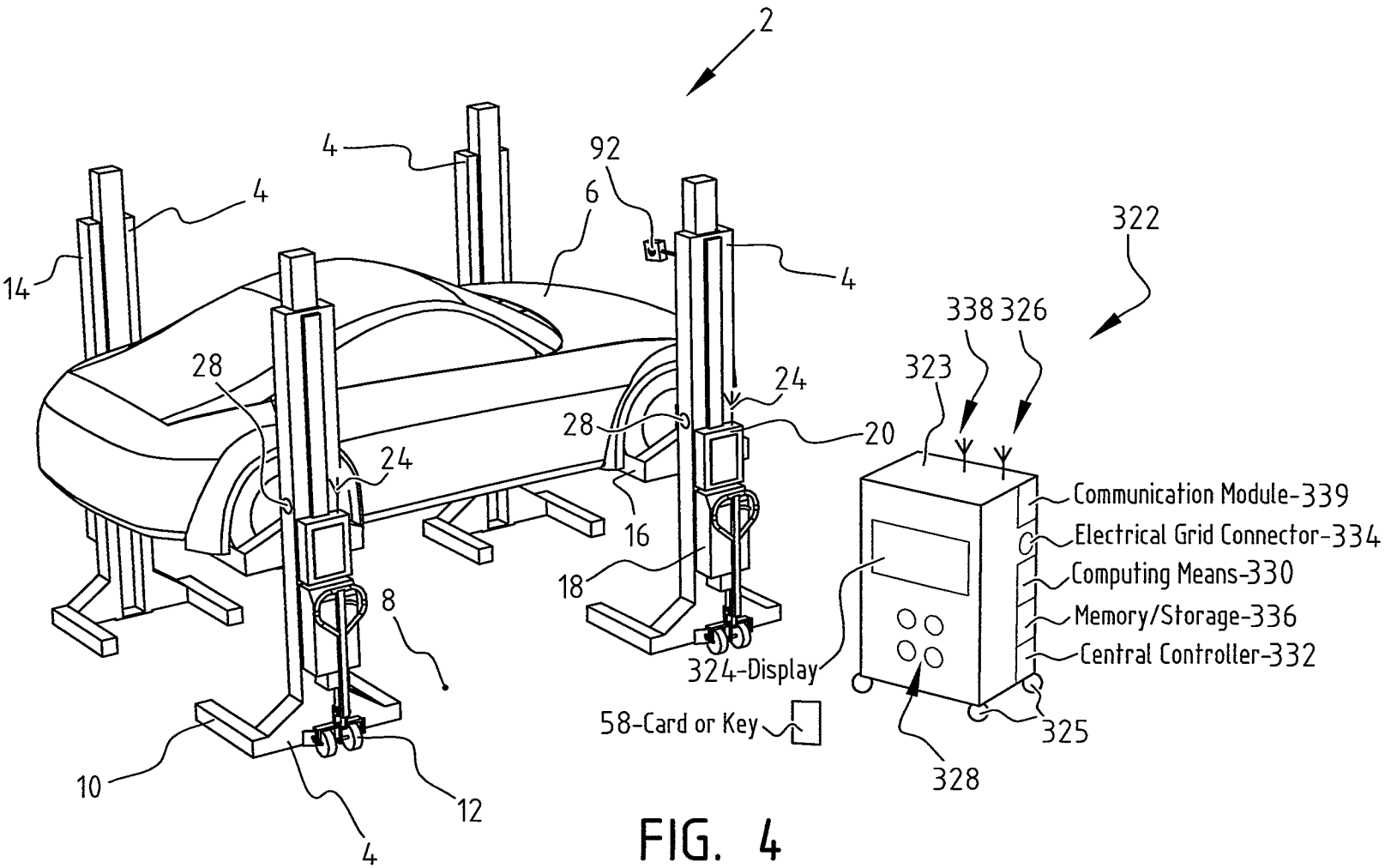
FIG. 4 shows a portable embodiment of a central controller.

In an alternative embodiment central controller 322 (FIG. 4) comprises a portable housing 323 with display 324, such as a touch screen, and wheels 325.

Transmitter/receiver 326 communicates signals between lifting columns 4 and central controller 322. Buttons 328 provide additional input means for a user. Central controller 322 further comprises computing means 330, battery 332, electrical grid connector 334, memory/storage 336, and separate external transmitter/receiver 338 as part of, or cooperating with, communication module 339.

Card or key 58 can be used to select lifting columns 4 and/or in a pay-per-lift or release procedure. Such pay-per-lift or release system will be described next and may be applied to all embodiments of the present invention.

Figure 5:
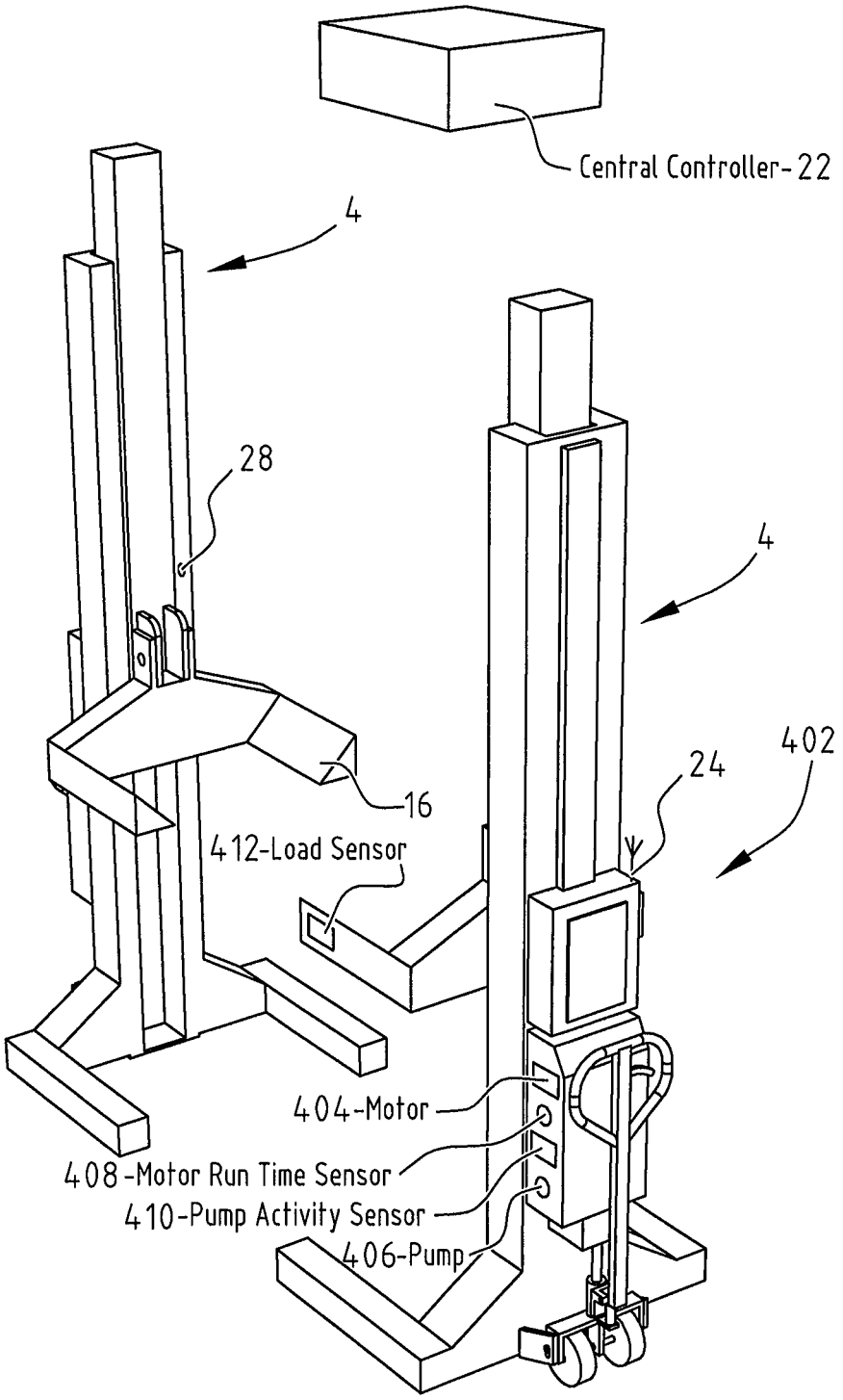
FIG. 5 shows a release system.

In a presently preferred embodiment lifting column 4 is provided with release system 402 (FIG. 5). In the illustrated embodiment central controller 22 provides a clearance signal to an individual lifting column 4 involving a release signal enabling the effective use of carrier 16. The release signal may release a software lock preventing motor 404 and/or pump 406 of lifting column 4 to operate. Alternatively, or in addition thereto, release signal may release a hardware lock, for example a clamp locking carrier 16. Payments can be received via card 52, generating payment instructions and sending the instructions to the accounting department of the user and/or receiving an authorization signal authorizing the system and user to perform a number of lifts and/or use lifting system 2 for a specific period of time.

Figure 6:
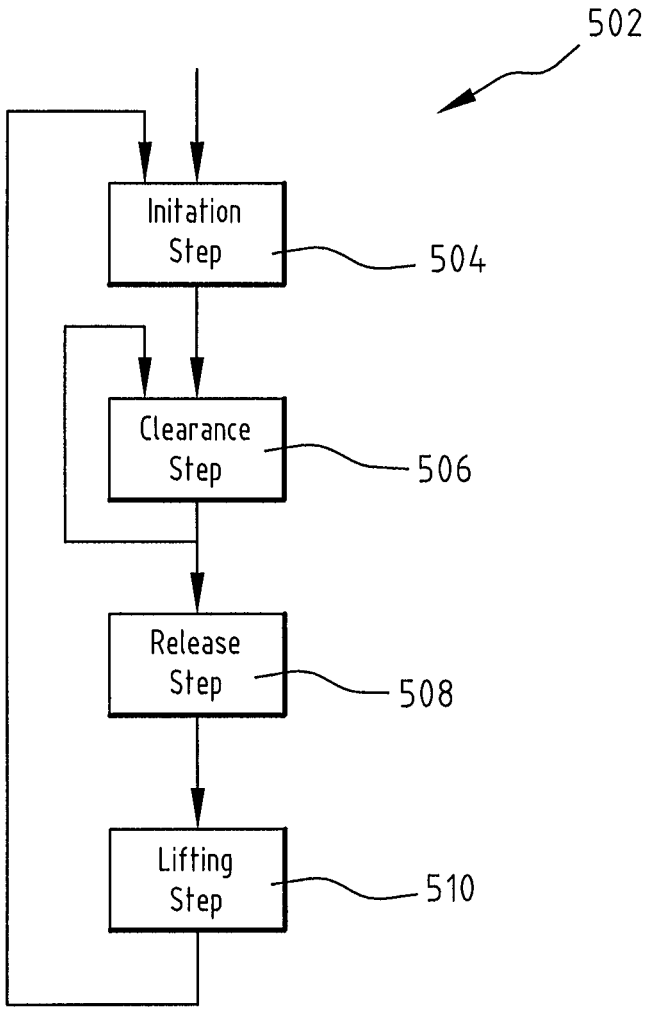
FIGS. 6 and 7 show pay-per-lift method(s).

Operation of lifting system 2 involves method 502 (FIG. 6) starting with initiation step 504. In clearance step 506 the clearance check is performed. In case clearance is confirmed system 2 is released by the release system in release step 508 and lifting step 510 can be started to perform the desired lifting.

Figure 7:
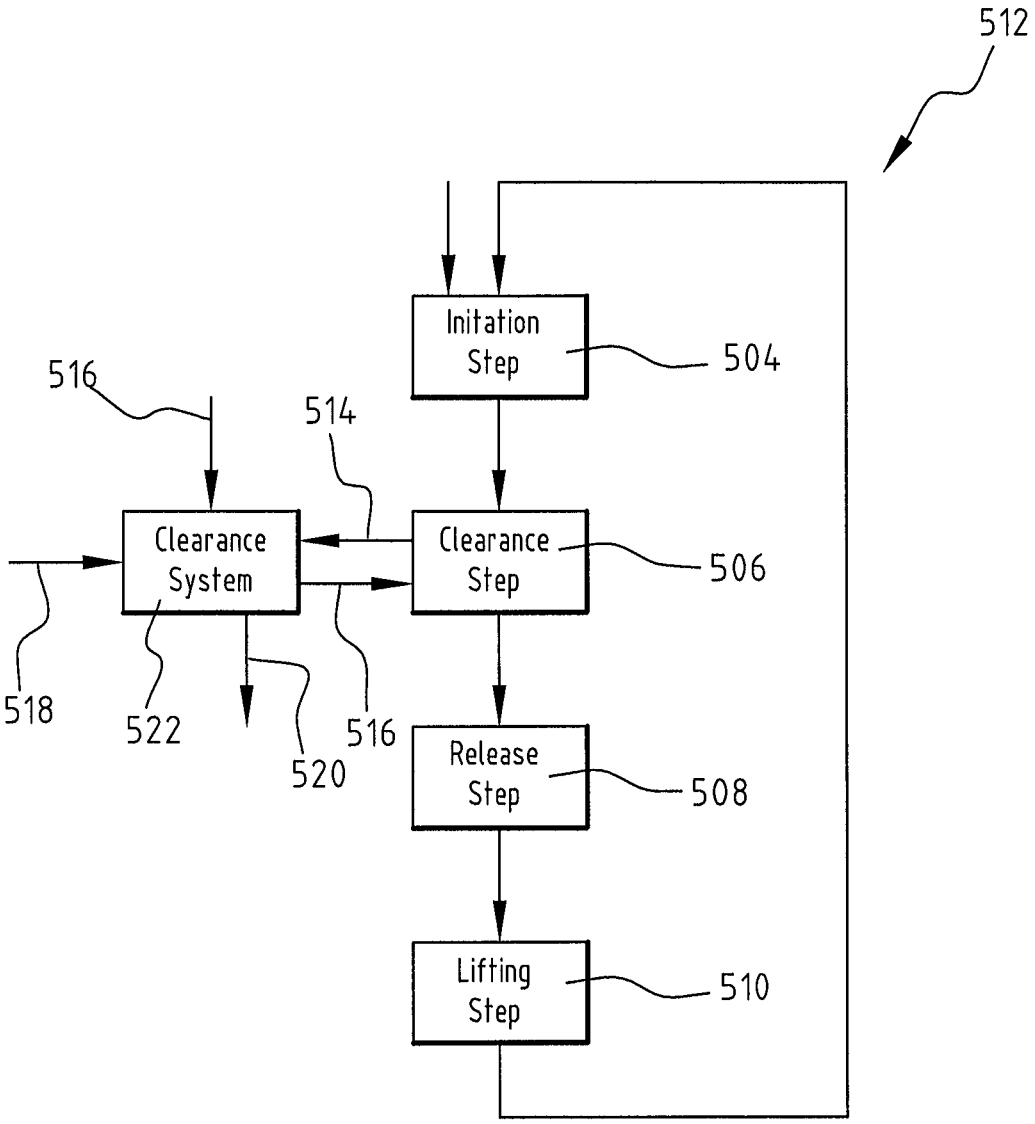

In an alternative method 512 (FIG. 7) clearance step 506 involves communication with a clearance system 522 involving a requesting step sending a request 514 for an authorization to use lifting system 2 and/or a reply step receiving a reply 516 relating to the authorization or denial to use lifting system 2. In order to send any authorization and/or clearance signals clearance system receives payments 516, for example with a pre-paid lift card 52, or payment confirmations 518, for example via an automatic debit order, and/or sends payment instructions 520.

Sensor 28 can be used to inform controller 22 of lifting activities of carrier 16. Alternatively, or in addition thereto, motor run time sensor 408 (FIG. 5) may provide controller 22 with motor run time information of motor 404 and/or pump activity sensor 410 may provide controller 22 with pump activity information of pump 406 and/or load sensor 412 may provide central controller 22 with information on the actual loads carried by carrier 16, preferably in combination with the time period the carrier 16 is exposed to the load.

Optionally, camera 92 (FIG. 1) provides information about the type of vehicle, such as a bus, truck or passenger car, to controller 20, 30 enabling the controller to adjust the settings of lifting system 2 and/or use vehicle specific information for debiting the user for the lifting operation that is performed. Optionally, camera 92 detects the vehicle registration, for example by the license plates, optionally providing the relevant information to the accounting department such that the vehicle owner can be debited for the actual lifting operation(s).

The present invention can be applied to the (wireless) lifting columns illustrated in the figures. Alternatively, the invention can also be applied to other types of lifting columns and lifting systems.

The present invention is by no means limited to the above described preferred embodiments. The rights sought are defined by the following claims within the scope of which many modifications can be envisaged. The present invention is described using a lifting device such as a lifting column and more specifically a mobile lifting column. The invention can also be applied to other type of lifting columns such as so-called boom-lifts, scissor-lifts and loading platforms. Such lifting equipment can be provided with the measures illustrated above according to the invention.

The invention claimed is:

1. A lifting system for lifting a vehicle comprising one or more lifting devices, each lifting device comprising:

a frame with a carrier configured for carrying the vehicle;

a drive for driving the carrier in at least one of the ascent or decent of the carrier;

a transmitter/receiver for wireless communication with a central controller;

a sensor for measuring at least one of the ascent or descent of the carrier; and wherein the lifting system comprises the central controller for centrally controlling the one or more lifting device, the central controller comprising:

a transmitter/receiver for communication with individual lifting devices; and computing means for determining required control actions for individual lifting devices, wherein at least one of the central controller or at least one of the lifting devices comprises user input means configured for providing the central controller with input, and wherein the central controller controls two or more independent groups of selected lifting devices, including at least a first group of lifting devices configured to lift a first vehicle and a second group of lifting devices configured to lift a second vehicle.

2. The lifting system according to claim 1, further comprising a signal distributor for receiving and forwarding signals between the central controller and one or more of the individual lifting columns.

3. The lifting system according to claim 1, wherein the central controller is movable.

4. The lifting system according to claim 1, wherein the central controller comprises communication means for communication with external networks.

5. The lifting system according to claim 1, wherein the controller comprises an input for receiving a clearance signal from a clearance system.

6. The lifting system according to claim 1, wherein the system comprises a release system for releasing the carrier enabling the lifting system to lift the vehicle in response to the clearance signal.

7. The lifting system according to claim 1, wherein the central controller comprises a transmitter and/or receiver for remotely controlling the release system.

8. The lifting system according to claim 1, wherein the sensor comprises a motor run time sensor, a load sensor, a displacement sensor and/or a pump activity sensor.

9. The lifting system according to claim 1, further comprising a vehicle detector.

10. A method for controlling a lifting system for lifting a vehicle comprising the steps:

providing a lifting system according to claim 1; and controlling the lifting system with the central controller.

11. The method according to claim 10, wherein the release signal is provided after receiving a clearance signal from a clearance system.

* * * * *